US010125643B2

(12) United States Patent
Katsumata et al.

(10) Patent No.: US 10,125,643 B2
(45) Date of Patent: Nov. 13, 2018

(54) VALVE OPERATING DEVICE FOR INTERNAL COMBUSTION ENGINE

(71) Applicant: TOYOTA JIDOSHA KABUSHIKI KAISHA, Toyota-shi, Aichi-ken (JP)

(72) Inventors: Shouji Katsumata, Gotenba (JP); Hidetoshi Hirose, Shizuoka-ken (JP)

(73) Assignee: TOYOTA JIDOSHA KABUSHIKI KAISHA, Toyota-shi (JP)

( * ) Notice: Subject to any disclaimer, the term of this patent is extended or adjusted under 35 U.S.C. 154(b) by 60 days.

(21) Appl. No.: 15/333,395

(22) Filed: Oct. 25, 2016

(65) Prior Publication Data

US 2017/0183988 A1 Jun. 29, 2017

(30) Foreign Application Priority Data

Dec. 24, 2015 (JP) ..... 2015-250801

(51) Int. Cl.

| | |
|---|---|
| ***F01L 1/26*** | (2006.01) |
| ***F01L 5/24*** | (2006.01) |
| ***F01L 5/02*** | (2006.01) |
| ***F01L 3/08*** | (2006.01) |
| ***F01L 3/20*** | (2006.01) |

(52) U.S. Cl.
CPC *F01L 5/24* (2013.01); *F01L 3/08* (2013.01); *F01L 3/20* (2013.01); *F01L 5/02* (2013.01); *F01L 2810/02* (2013.01)

(58) Field of Classification Search
CPC ..... F01L 5/24; F01L 5/02; F01L 3/08; F01L 3/20; F01L 2810/02
See application file for complete search history.

(56) References Cited

FOREIGN PATENT DOCUMENTS

| | | |
|---|---|---|
| JP | S62-186007 A | 8/1987 |
| JP | H08-21216 A | 1/1996 |

*Primary Examiner* — Zelalem Eshete
(74) *Attorney, Agent, or Firm* — Hunton Andrews Kurth LLP

(57) ABSTRACT

In an engine valve, a first sliding area formed at a valve head side in an outer face of a valve stem, and sliding along a stem guide, a second sliding area formed at an opposite side from the valve head side, and sliding along the stem guide, and a first small diameter area formed between the first sliding area and the second sliding area are formed. Further, in the engine valve, a length, in an axial direction of the valve stem, of the first sliding area abutting on the stem guide at a position where the engine valve is fully opened is longer as compared with a length, in the axial direction of the valve stem, of the second sliding area abutting on the stem guide at a position where the engine valve is fully closed.

2 Claims, 3 Drawing Sheets

VALVE OPERATING DEVICE FOR INTERNAL COMBUSTION ENGINE

CROSS-REFERENCE TO RELATED APPLICATION

The present application claims priority to Japanese Patent Application No. 2015-250801 filed on Dec. 24, 2015, which is incorporated herein by reference in its entirety.

BACKGROUND

Field

The present invention relates to a valve operating device for an internal combustion engine including an engine valve that is used as an intake valve or an exhaust valve.

Discussion of Background

There has been known an engine valve in which a part of an outer face of a valve stem is formed as a small diameter area (refer to a following Patent Literature 1, for example).

Specifically, in the engine valve disclosed in Patent Literature 1, a part of the outer face of the valve stem that slides along the stem guide is formed as a small diameter area, and thereby the engine valve is reduced in weight.

Following is a list of patent literatures which the applicant has noticed as related arts of the present invention.

Patent Literature 1: Japanese Patent Application Publication No. 62-186007 A

SUMMARY

However, in the known device, a small diameter area is formed in a part of the outer face of the valve stem that slides along the stem guide, whereby the amount of the lubricating oil passing through the clearance between the stem guide and the valve stem increases as compared with that of the engine valve which is not provided with a small diameter area. Further, on the area of the valve stem sliding along the stem guide near a valve head, the viscosity of the lubricating oil is reduced as the temperature of the lubricating oil increases by combustion in the cylinder. Therefore, on the area of the valve stem sliding along the stem guide near the valve head, the amount of the lubricating oil passing through the clearance increases as compared with that on the area of the valve stem sliding along the stem guide far from the valve head. As a result, on the area of the valve stem sliding along the stem guide near the valve head, abrasion occurs more easily in the stem guide and the valve stem as compared with on the area of the valve stem sliding along the stem guide far from the valve head.

Preferred embodiments address the aforementioned problem. That is, Preferred embodiments has an object to provide a valve operating device for an internal combustion engine that is applied to an engine valve having a small diameter area in a part of an outer face of a valve stem, and restrains occurrence of abrasion between components, i.e. between a sliding are of a valve stem and a stem guide.

The valve operating device according to the preferred embodiments is an valve operating device for an internal combustion engine including an engine valve and a valve drive device, The engine valve includes a valve stem portion and a valve head portion connected to one end of the valve stem portion. The valve stem portion includes a cylindrical sliding area sliding along a stem guide and a first small diameter area having a smaller diameter as compared with a diameter of the sliding area. The valve drive device drives the engine valve between a fully opened position where a lift amount of the valve head portion becomes maximum to an opening side, and a fully closed position where the lift amount becomes minimum. The sliding area includes a first sliding area between the valve head portion and the first small diameter area, and a second sliding area between the first small diameter area and the other end of the valve stem portion. A length in an axial direction of the first sliding area abutting on the stem guide at the fully opened position is longer as compared with a length in an axial direction of the second sliding area abutting on the stem guide at the fully closed position.

According to the above, in a time period in which the engine valve slides between the fully closed position and the fully opened position, the length in the axial direction of the first sliding area abutting on the stem guide is longer as compared with the length in the axial direction of the second sliding area abutting on the stem guide. Accordingly, the lubricating oil retentivity of the first sliding area where abrasion occurs more easily as compared with in the second sliding area can be made larger than the lubricating oil retentivity of the second sliding area. As a result, abrasion of the stem guide and the valve stem portion can be restrained, with the small diameter area formed in the valve stem portion.

Further, in one aspect of the valve operating device, the valve stem further includes a second small diameter area having a smaller diameter as compared with the sliding area between the valve head and the first sliding area, and the second small diameter area resides at a position abutting on the stem guide at the fully closed position.

According to the above, as compared with the engine valve in which the second small diameter area is not provided, the engine valve can be reduced in weight.

DESCRIPTION of EMBODIMENTS

Hereinafter, an engine valve according to each of embodiments will be described with reference to the drawings.

First Embodiment

Figure 1:
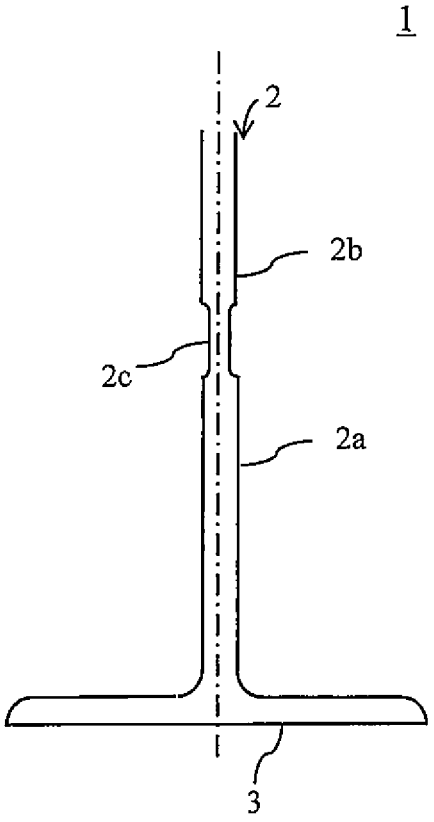
FIG. 1 is a schematic sectional view of an engine valve according to a first embodiment.

With reference to FIG. 1, an engine valve according to a first embodiment will now be described. In FIG. 1, in an engine valve 1, a valve head 3 is integrally connected to one end of a valve stem 2. Further, in an outer face of the valve stem 2, a first sliding area 2*a* and a second sliding area 2*b* that slide along a stem guide 16 that will be described later are formed. In the outer face of the valve stem 2 between the first sliding area 2*a* and the second sliding area 2*b*, a first small diameter area 2*c* having a smaller diameter as compared with diameters of the first sliding area 2*a* and the second sliding area 2*b* is formed.

(Effect of the Valve Stem Having a Small Diameter Area on the Outer Face Thereof in the Engine Valve)

In the case of a configuration in which the first small diameter area 2*c* is provided in a part of the outer face of the valve stem 2 of the engine valve 1 as illustrated in FIG. 1, the amount of a lubricating oil passing through the clearance between the stem guide 16 and the valve stem 2 for discharging increases as compared with an engine valve that is not provided with the first small diameter area 2*c*, and the retentivity of the lubricating oil flowing between the stem guide 16 and the valve stem 2 is reduced.

Figure 2:
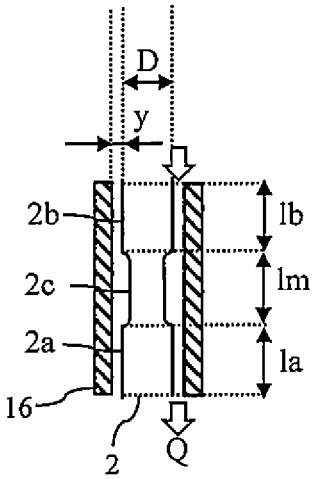
FIG. 2 illustrates a flow of a lubricating oil in a clearance between a valve stem and a stem guide in the engine valve according to the first embodiment.

The flow of lubricating oil will now be explained in detail with reference to FIG. 2. FIG. 2 illustrates a flow of the lubricating oil in the clearance between the valve stem 2 and the stem guide 16 of the engine valve 1. "D" denotes the diameter of the valve stem 2, "y" denotes the dimension of the radial clearance radial between the valve stem 2 and the stem guide 16, "la" denotes the length, in an axial direction of the valve stem 2, of the first sliding area 2*a* abutting on the stem guide 16, "lb" denotes the length, in an axial direction of the valve stem 2, of the second sliding area 2*b* abutting on the stem guide 16, "lm" denotes the length, in the axial direction of the valve stem 2, of the first small diameter area 2*c* abutting on the stem guide 16, and "Q" denotes the amount of oil passing through the clearance between the valve stem 2 and the stem guide 16. Note that "abutting" indicates that the stem guide 16 contacts the outer face of the valve stem 2 directly or via the lubricating oil.

The amount of lubricating oil Q passing through the clearance between the stem guide 16 and the valve stem 2 can be expressed by a formula (Formula 1) of an annular clearance, as is described below.

$$Q = \frac{\pi d y^3}{12\,\mu l}\Delta p \qquad \text{(Formula 1)}$$

In Formula 1, "Δp" denotes the differential pressure, "μ" denotes the viscosity coefficient of the lubricating oil, and "l" denotes the length of the radial clearance.

Detailed explanation of the formula of the annular clearance will be omitted because the formula of the annular clearance is a known formula. When the small diameter area 2*c* is not formed in the outer face of the engine valve 1, the dimension l of the length of the radial clearance is the sum of la, lb and lm. When the first small diameter area is formed in the sliding area of the valve stem 2 as illustrated in FIG. 2, the dimension l of the length of the radial clearance in the first sliding area 2*a* is la, and the dimension l of the length of the radial clearance in the second sliding area 2*b* is lb. Consequently, according to Formula 1, the oil amount Q1 passing through the clearance between the first sliding area 2*a* and the stem guide 16 and the oil amount Q2 passing through the clearance between the second sliding area 2*b* and the stem guide 16 become larger than the oil amount passing between the valve stem and the valve guide in the case where the small diameter area 2*c* is not formed. As a result, forming the first small diameter area 2*c* reduces the retentivity of the lubricating oil in the clearance between the stem guide 16 and the valve stem 2 as compared with the case where the small diameter area 2*c* is not formed.

In addition, in the first sliding area 2*a*, a temperature of the lubricating oil increases by combustion in a combustion chamber, and a viscosity coefficient μ of the lubricating oil is reduced. Consequently, in the first sliding area 2*a*, the retentivity of the lubricating oil is easily reduced as compared with in the second sliding area 2*b*. In the first sliding area 2*a*, abrasion is thus more likely to occur between components as compared with in the second sliding area 2*b*.

Thus, in the first embodiment, the length, in the axial direction of the valve stem 2, of the first sliding area 2*a* abutting on the stem guide 16 at the fully opened position where the engine valve 1 is fully opened is configured to be longer as compared with the length, in the axial direction of the valve stem 2, of the second sliding area 2*b* abutting on the stem guide 16 at a position where the engine valve 1 is fully closed. Explanation will be made more specifically with reference to FIGS. 3A and 3B.

Figure 3A:
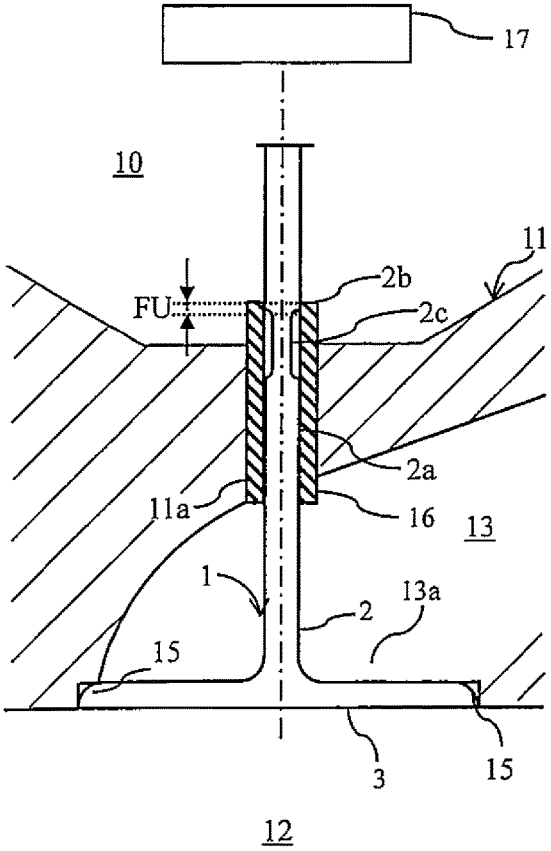
FIG. 3A is a schematic sectional view at a time of the engine valve being at a fully closed position in a case where the engine valve according to the first embodiment is assembled to an internal combustion engine.
Figure 3B:
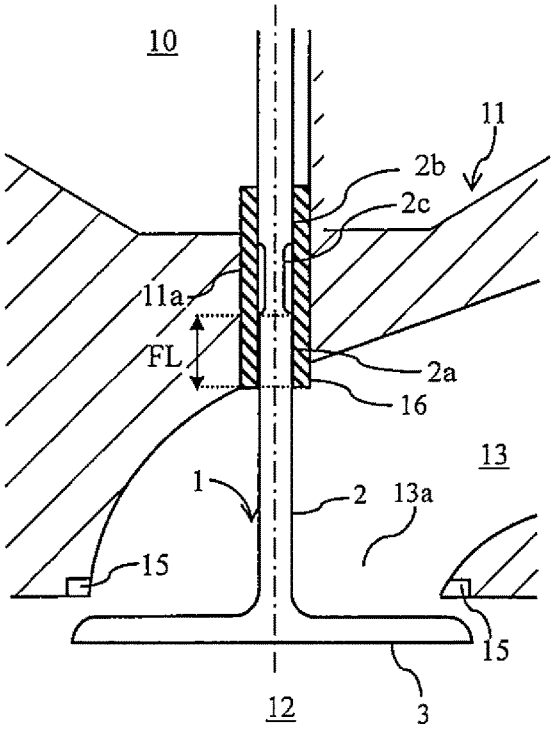
FIG. 3B is a schematic sectional view at a time of the engine valve being at a fully opened position in the case where the engine valve according to the first embodiment is assembled to an internal combustion engine.

FIG. 3A and FIG. 3B illustrate views of the aforementioned engine valve 1 being assembled to a cylinder head 11 of an internal combustion engine 10. In the cylinder head 11, an intake port 13 leading to a combustion chamber 12 is formed. In schematic sectional views illustrated in FIG. 3A and FIG. 3B each illustrate a section of the cylinder head 11 that is cut to include a central part in a radial direction of the intake port 13. Further, an opening portion 13*a* facing the combustion chamber 12, of the intake port 13 is formed to be substantially circular, and a valve seat 15 where the valve head 3 of the engine valve 1 sits is provided on a periphery of the opening portion 13*a*.

Further, in the cylinder head 11, a through-hole 11*a* that is opened at a position substantially facing the opening portion 13*a* of the intake port 13 is formed toward the intake port 13 from outside. The through-hole 11*a* is formed in such a position that a center line of the through-hole 11*a* passes through a substantial center of the opening portion 13*a*. In the through-hole 11*a*, the cylindrical stem guide 16 is press-fitted.

The valve stem 2 of the engine valve 1 is slidably attached to the cylinder head 11 via the stem guide 16. The valve head 3 is connected to one end of the valve stem 2, and the other end at an opposite side of the valve stem 2 is connected to a valve drive device 17 using a cam or the like not illustrated. The engine valve 1 can seat or separate the valve head 3 in or from the valve seat 15 by advancing and retreating the valve stem 2 by the valve drive device 17. To the clearance between the valve stem 2 and the stem guide 16, the lubricating oil is supplied from the valve drive device 17 side.

FIG. 3A illustrates the fully closed position where the valve head 3 sits on the valve seat 15, and FIG. 3B illustrates the fully opened position where the engine valve 1 reaches a maximum opening amount. The first sliding area 2*a* and the second sliding area 2*b*, which slide during the engine valve 1 moving between the fully closed position illustrated in FIG. 3A and the fully opened position illustrated in FIG. 3B, are formed in the outer face of the valve stem 2 that is inserted in the stem guide 16. The first sliding area 2*a* slides along the stem guide 16 at the valve head 3 side, and the second sliding area 2*b* slides along the stem guide 16 at a side opposite to the valve head 3. Further, the first small diameter area 2*c* having a smaller diameter as compared with a diameter of the first sliding area 2*a* and a diameter of the second sliding area 2*b* is formed between the first sliding area 2*a* and the second sliding area 2*b*. In addition, the length FL, in the axial direction of the aforementioned valve stem 2, of the first sliding area 2*a* abutting on the stem guide 16 at the fully opened position illustrated in FIG. 3B is longer as compared with the length FU, in the axial direction of the valve stem 2, of the second sliding area 2*b* abutting on the stem guide 16 at the fully closed position illustrated in FIG. 3A.

According to the first embodiment, in a time period in which the engine valve 1 slides between the fully closed position and the fully opened position, the length in the axial direction of the first sliding area 2*a* abutting on the stem guide 16 is longer as compared with the length in the axial direction of the second sliding area 2*b* abutting on the stem guide 16. Accordingly, the lubricating oil retentivity in the first sliding area 2*a* where abrasion is more likely to occur as compared with in the second sliding area 2*b* can be made larger than the lubricating oil retentivity in the second sliding area 2*b*. As a result, abrasion of the stem guide 16 and the valve stem 2 can be restrained, with the first small diameter area 2*c* formed in the valve stem 2.

Second Embodiment

Figure 4:
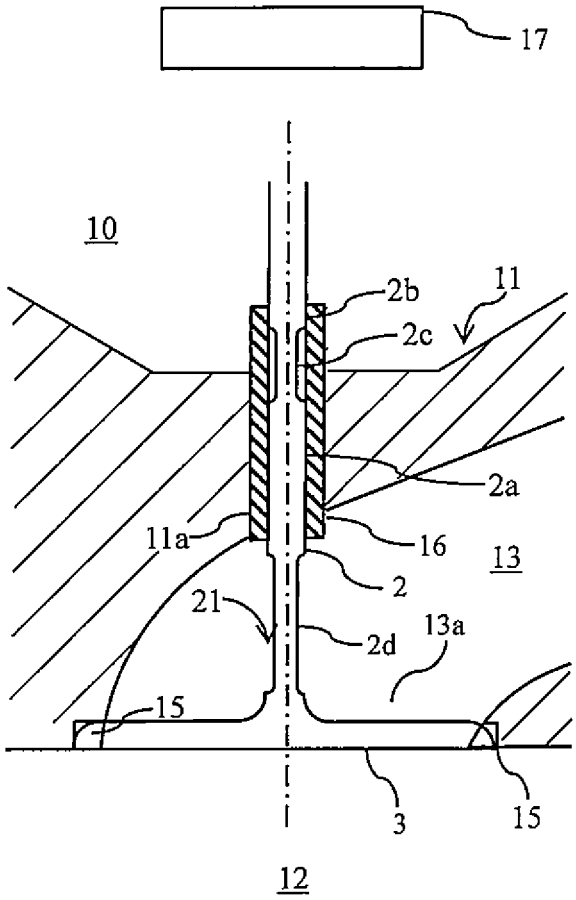
FIG. 4 is a schematic sectional view of a case where an engine valve according to a second embodiment of the present invention is assembled to an internal combustion engine.

An engine valve 21 according to a second embodiment differs from the engine valve 1 according to the first embodiment in a feature in which a second small diameter area 2*d* that has a smaller diameter as compared with the diameter of the first sliding area 2*a* and the diameter of the second sliding area 2*b* is formed in the outer face of the valve stem 2 between the valve head 3 and the first sliding area 2*a*, as illustrated in FIG. 4. Hereinafter, the similar components, the mechanisms and the like to those in the first embodiment will be assigned with the same reference signs, and detailed explanation will be omitted.

FIG. 4 is a view of the engine valve 21 according to the second embodiment being assembled to the internal combustion engine 10, and illustrates the fully closed position where the valve head 3 sits on the valve seat 4. In the engine valve 21, the second small diameter area 2*d* having a smaller diameter as compared with the diameter of the first sliding area 2*a* and the diameter of the second sliding area 2*b* is formed in the outer face of the valve stem between the valve head 3 and the first sliding area 2*a* as described above. Further, the engine valve 21 is assembled to a position where the second small diameter area 2*d* does not abut on the stem guide 16 at the fully closed position, and the second small diameter area 2*d* is exposed to the intake port 13.

According to the second embodiment, the engine valve 21 can be reduced in weight as compared with the engine valve which is not provided with the second small diameter area 2*d*. In addition, providing the second small diameter area 2*d* can reduce a flow path resistance of an intake passage as compared with the engine valve which is not provided with the second small diameter area 2*d*, and therefore, pressure loss of intake air can be reduced.

As described above, according to the respective embodiments, between the fully opened position and the fully closed position, a ratio of the length in the axial direction of the first sliding area 2*a* abutting on the stem guide 16 being longer as compared with the length in the axial direction of the second sliding area 2*b* abutting on the stem guide 16 becomes large. Accordingly, reduction in retentivity of the lubricating oil in the first sliding area 2*a* can be restrained. As a result, abrasion of the stem guide 16 and the valve stem 2 in the first sliding area 2*a* can be restrained.

The present disclosure is not limited to the above described embodiments, and various modification examples can be adopted within the range of the present invention. Although in each of the above described embodiments, the engine valve is configured to be disposed in the intake port is adopted, the engine valve may be configured to be provided in an exhaust port, for example.

REFERENCE SIGNS LIST

1 Engine valve 2 Valve stem 3 Valve head 10 Internal combustion engine 16 Stem guide

What is claimed is:

1. A valve operating device for an internal combustion engine, comprising:

an engine valve comprising a valve stem portion and a valve head portion connected to one end of the valve stem portion, the valve stem portion including a cylindrical sliding area sliding along a stem guide and a first small diameter area having a smaller diameter as compared with a diameter of the sliding area; and a valve drive device configured to drive the engine valve between a fully opened position where a lift amount of the valve head portion becomes maximum to an opening side, and a fully closed position where the lift amount becomes minimum, wherein the sliding area includes a first sliding area between the valve head portion and the first small diameter area, and a second sliding area between the first small diameter area and the other end of the valve stem portion; and an amount of lubricating oil Q passing through clearance between the stem guide and the valve stem portion is represented by Formula 1, wherein Δp represents differential pressure, μ represents viscosity coefficient of the lubricating oil, and l represents either a length la of radial clearance in the first sliding area or a length lb of radial clearance in the second sliding area, wherein $$Q = \frac{\pi d y^3}{12\ \mu l}\Delta p \qquad \text{(Formula 1)}$$

the length la in an axial direction of the first sliding area abutting on the stem guide at the fully opened position is longer as compared with the length lb in an axial direction of the second sliding area abutting on the stem guide at the fully closed position, so that lubricating oil retentivity in the first sliding area is larger than lubricating oil retentivity in the second sliding area.

2. The valve operating device for an internal combustion engine according to claim 1, wherein the valve stem portion further includes a second small diameter area having a smaller diameter as compared with a diameter of the first sliding area between the valve head portion and the first sliding area, and the second small diameter area resides at a position not abutting on the stem guide at the fully closed position.

* * * * *